US007717642B2

(12) United States Patent
Patten

(10) Patent No.: US 7,717,642 B2
(45) Date of Patent: May 18, 2010

(54) BUOYANCY STABILIZED PIER

(76) Inventor: Roger Patten, 1215 SW. 149th, Burien, WA (US) 98166

( * ) Notice: Subject to any disclaimer, the term of this patent is extended or adjusted under 35 U.S.C. 154(b) by 711 days.

(21) Appl. No.: 11/591,202

(22) Filed: Oct. 31, 2006

(65) Prior Publication Data

US 2007/0094816 A1 May 3, 2007

Related U.S. Application Data

(60) Provisional application No. 60/732,268, filed on Nov. 1, 2005.

(51) Int. Cl.

| | |
|---|---|
| ***E01C 7/32*** | (2006.01) |
| ***E01C 3/00*** | (2006.01) |
| ***E02B 17/08*** | (2006.01) |
| ***B63B 35/44*** | (2006.01) |

(52) U.S. Cl. ..... 404/75; 404/27; 405/203; 114/264; 114/267

(58) Field of Classification Search ..... 14/27, 14/75; 114/267, 264, 265; 405/200, 203, 405/205

See application file for complete search history.

(56) References Cited

U.S. PATENT DOCUMENTS

| | | | | | |
|---|---|---|---|---|---|
| 1,934,286 | A | * | 11/1933 | Tourchette | 14/27 |
| 2,009,461 | A | * | 7/1935 | Wichert | 405/11 |
| 2,997,852 | A | * | 8/1961 | Suderow | 405/201 |
| 3,131,542 | A | * | 5/1964 | Koch | 405/219 |
| 3,689,953 | A | * | 9/1972 | Markakis | 14/27 |
| 3,898,847 | A | * | 8/1975 | Magnanini | 405/207 |
| 3,933,111 | A | * | 1/1976 | von Bose et al. | 405/212 |
| 3,975,476 | A | | 8/1976 | Finsterwalder | |
| 3,979,787 | A | * | 9/1976 | Ahlgren | 14/75 |
| 4,012,917 | A | * | 3/1977 | Gendron | 405/199 |
| 4,337,545 | A | * | 7/1982 | Rose et al. | 14/71.1 |
| 4,716,696 | A | | 1/1988 | Yacoboni | |
| 4,742,591 | A | | 5/1988 | Muller | |
| 4,890,959 | A | * | 1/1990 | Robishaw et al. | 405/204 |
| 4,918,777 | A | * | 4/1990 | Ashley | 14/73 |

(Continued)

OTHER PUBLICATIONS

"The Bridge," NewBayBridge.org, n.d., <http://www.newbaybridge.org/the_bridge.html<[retrieved May 8, 2007], 3 pages.

(Continued)

*Primary Examiner*—Thomas B Will
*Assistant Examiner*—Abigail A Risic
(74) *Attorney, Agent, or Firm*—Christensen O'Connor Johnson Kindness PLLC

(57) ABSTRACT

A bridge and pier structure are disclosed for extending over a waterway, wherein the pier structure includes a chamber filled with air or other buoyant material such that a buoyancy force is produced. The chamber is sized and filled such that the buoyancy force offsets at least eighty or ninety percent of the weight of the bridge that is supported by the pier. The pier structure includes a footing portion that is embedded into the bed of the waterway, and an optional piling extends downwardly from the footing to engage more stable strata. In an embodiment of the invention, the pier includes a relatively large upper portion that defines the buoyant chambers, and a relatively narrow portion that extends down to the footing portion of the pier. In an embodiment, a bumper assembly is disposed about the pier, to protect the pier and provide a platform for other activities.

10 Claims, 5 Drawing Sheets

U.S. PATENT DOCUMENTS

| | | | | |
|---|---|---|---|---|
| 5,495,631 | A * | 3/1996 | Connor et al. | 14/2.6 |
| 6,050,207 | A * | 4/2000 | Mays | 114/45 |
| 6,082,931 | A * | 7/2000 | Hopper | 405/218 |
| 6,663,322 | B1 * | 12/2003 | Listle | 405/239 |
| 7,104,329 | B2 * | 9/2006 | Kleinhans | 166/355 |
| 7,117,810 | B2 * | 10/2006 | Kristensen et al. | 114/265 |
| 7,200,887 | B1 * | 4/2007 | Powers et al. | 14/27 |
| 2003/0168864 | A1 * | 9/2003 | Heronemus et al. | 290/55 |

OTHER PUBLICATIONS

"Bridgespeak, The Language of Engineering and Bridge-Building," NewBayBridge.org, n.d., <http://www.newbaybridge.org/the_bridge/bridgespeak.html> [retrieved May 8, 2007], 10 pages.

"Prefabricated Bridge Elements and Systems in Japan and Europe, Chapter 2: Findings on Prefabricated Bridge Systems" U.S. Dept. of Transportation, Federal Highway Administration, <http://international.fhwa.dot.gov/prefab_bridges/chapter_two_a.htm> [retrieved May 8, 2007], 23 pages.

* cited by examiner

BUOYANCY STABILIZED PIER

CROSS-REFERENCE TO RELATED APPLICATION

This application claims the benefit of U.S. Provisional Application No. 60/732,268, filed Nov. 1, 2005, the disclosure of which is hereby expressly incorporated by reference in its entirety, and priority from the filing date of which is hereby claimed under 35 U.S.C. §119.

BACKGROUND

The present invention is in the field of bridge construction and, more particularly, to support structures for over-water bridges. The engineering challenges involved in designing and constructing large bridge structures, such as suspension bridges and cable stayed bridges are legion. The bridge structure must have sufficient strength to support itself, the design live loads such as traffic, while also withstanding environmental loads including, for example, wind and other dynamic fluid loads, potential seismic loads, and the like. Typically the bridge structure will be designed to provide both the requisite rigidity to react certain design loads, and a certain amount of flexibility to endure other design loads without catastrophic failure. Moreover, the bridge structure is generally intended to be a permanent structure, and therefore must be designed to maintain its strength and stability over time.

Of course, bridges are often built over bodies of water, and rely on support structures that extend into the body of water, and to and into the bed beneath the body of water. Such supports, which may comprise caissons and piers, for example, that extend generally from the bed, out of the water to the bridge deck.

Designing suitable support structures for use in estuarial bodies of water having relatively poorly defined sedimentary layers that include significant quantities of fine particles can be very difficult. The support structure generally must provide a very stable support that will transmit very large reaction forces to the ground, while also being flexible enough to withstand loads relating to large episodic events such seismic events, but must do so in a sedimentary environment that is not conducive to reacting such loads.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In an embodiment of the present invention a buoyancy-stabilized pier for supporting a bridge structure over a waterway is disclosed. The pier includes one or more buoyant chambers, such that the pier produces a large, upwardly-directed force. The pier is sized such that the buoyancy force is at least eighty percent of the bridge dead weight that is intended to be supported by the pier. The pier includes a footing portion that is embedded into the waterway bed. However, due to the buoyancy force, the waterway bed does not need to react all of the loads associated with the dead weight of the bridge.

A bumper assembly may be provided surrounding the pier, the bumper assembly being attached to the pier with a plurality of extendible, shock absorbing members.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
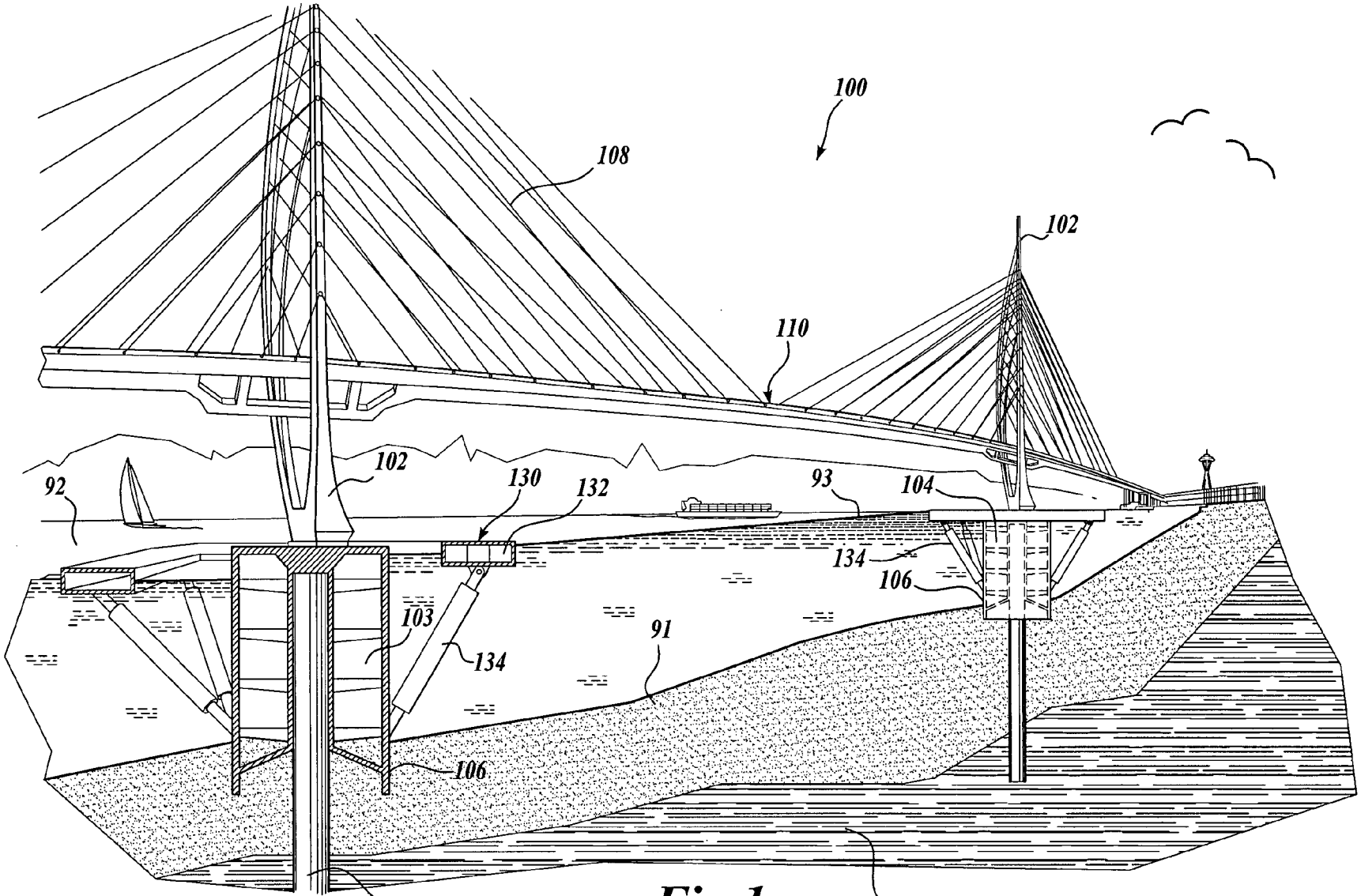
FIG. 1 is a perspective view of a cable stayed bridge in accordance with the present invention, wherein caisson piers are shown in cross-section.

A perspective sketch of a cable stayed bridge 100 according to the present invention is shown in FIG. 1, extending over a waterway 92, in this particular sketch, and for exemplary purposes only, the estuarial waters of Elliott Bay, in the Puget Sound. The cable stayed bridge 100 includes a bridge deck 110 that is disposed over the waterway 92, for at least a portion of its length, some distance above the waterline 93. For example, the bridge deck 110 may be positioned high enough over the waterline 93 to permit nautical traffic to pass therebelow. The bridge deck 110 is supported by one or more tower structures or pylons 102, each tower structure 102 extending upwardly from one of the piers 104. The pier 104 extends into the water, and includes a footing portion 106 that is substantially embedded in the sediment of the waterway bed 91.

Two piers 104 are shown in FIG. 1, although more or fewer piers may be utilized for a particular bridge. The piers 104 in this embodiment have an open, generally caisson-type construction, that is open at the bottom. The bridge deck 110 is suspended by a plurality of cable stays 108 that suspend the bridge deck 110 from the tower structures 102. In the embodiment shown in FIG. 1, a bumper assembly 130 is provided around each of the piers 104. The bumper assembly 130 includes a generally annular, buoyant platform 132 that is attached to the pier 104 with a plurality of extendible connecting members 134. The connecting members preferably operate as shock absorbers to protect the pier from any impact loads, for example resulting from inadvertent collisions by watercraft into the bumper assembly 130.

It will be appreciated that the bumper assembly 130 will not only protect the piers 104 from potential damage from watercraft, floating debris and the like passing under the bridge 100, but may also provide a convenient platform for various activities, for example performing routine bridge inspections, docking, or for conducting other activities not directly related to the bridge 100, such as estuary monitoring programs, recreational activities, or the like. The platform 132 may conveniently be generally polygonal in plan form, for example octagonal, to accommodate such other uses, including, for example, to facilitate watercraft docking.

In this embodiment the piers 104 are essentially caissons that extend from the waterway bed 91 up approximately to the water line 93. A substantial portion of the structure of each pier 104 comprises one or more hollow chambers 103 that are filled with air, or alternatively are at least partially filled with a lightweight polymeric foam or the like, thereby providing an upward buoyancy force, such that the waterway bed 91 does not react all of the forces related to the bridge 100 structure. A watertight lining may be provided covering the walls of the chamber 103, and/or a polymeric foam or a bladder (not shown) may be provided in the chamber 103, to prevent undesired water incursion into the pier 104.

An optional anchor or piling 107 extends from each pier 104, preferably to engage bedrock 94 or other materials more stable and compacted than the material comprising the waterway bed 91.

Figure 2:
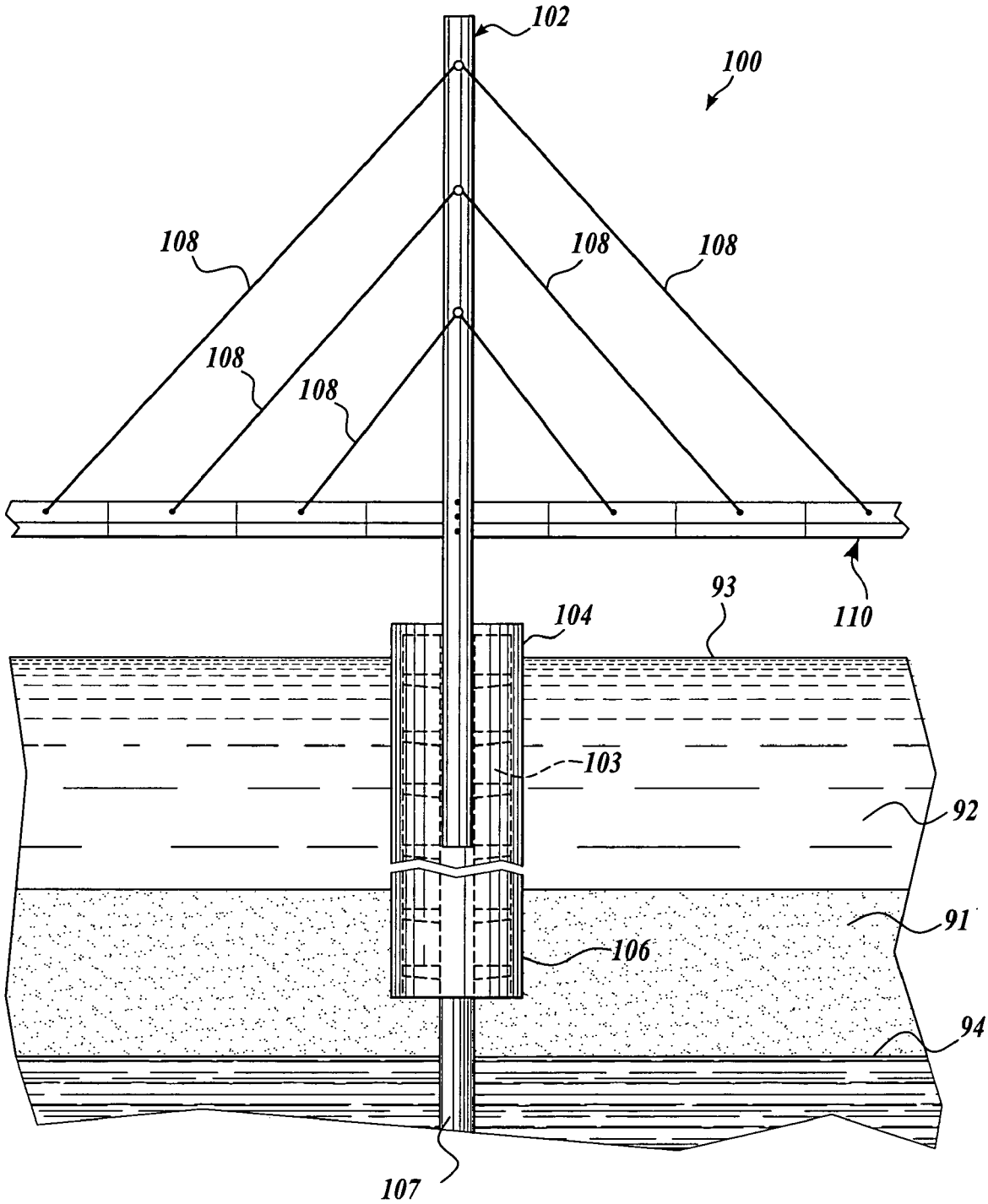
FIG. 2 is a side view of a portion of a cable stayed bridge according to the present invention.
Figure 3:
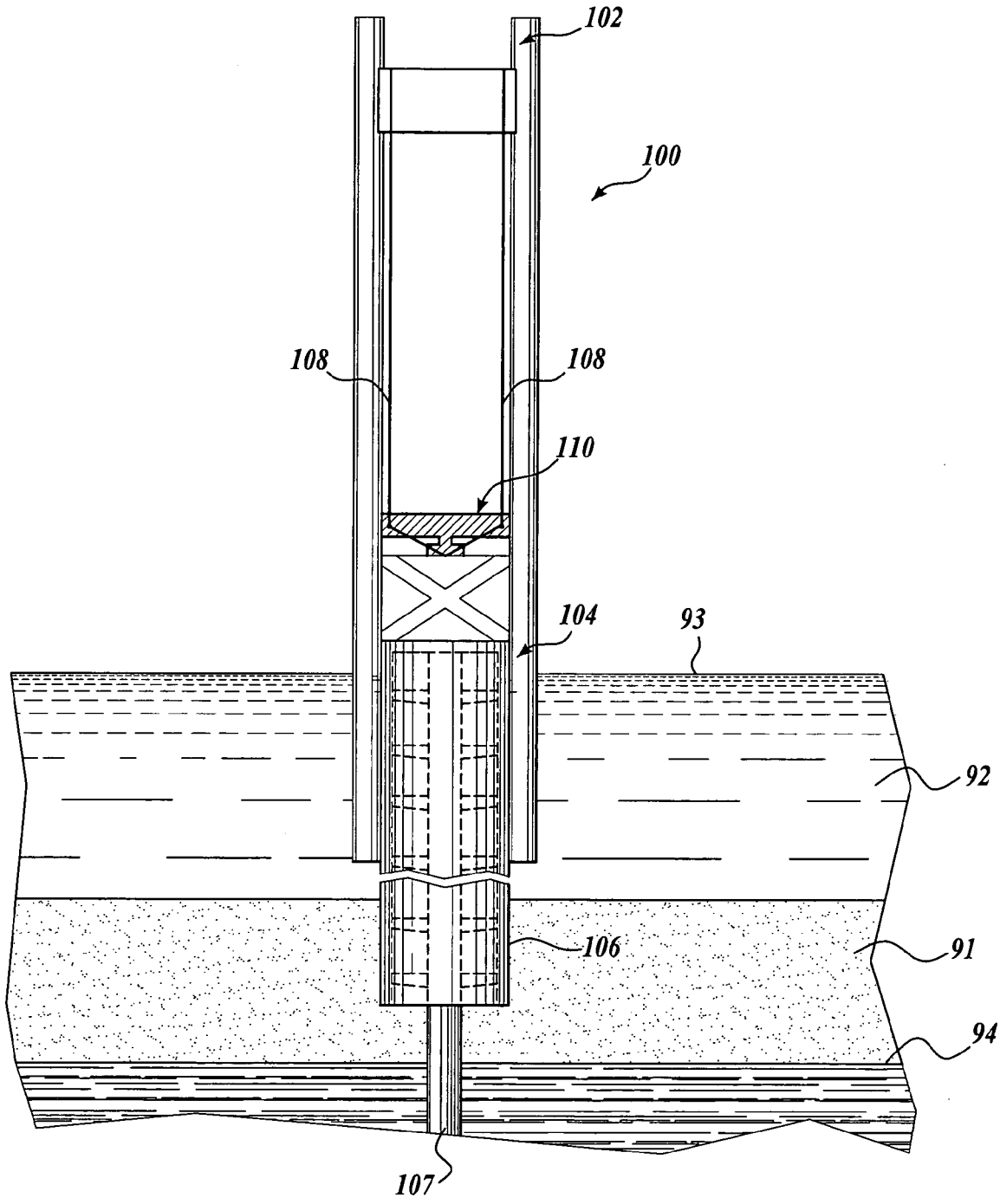
FIG. 3 is a front view of the cable stayed bridge shown in FIG. 1.

A side view of the bridge 100 is shown in FIG. 2, and a fragmentary front view of the bridge 100 is shown in FIG. 3, with the bumper structure 130 removed, and the bridge deck 110 simplified, for clarity in illustrating novel aspects of the piers 104. The piers 104 in this embodiment are generally hollow cylinders, that may be formed for example of reinforced concrete, each with a footing portion 106 embedded in the waterway bed 91, and the upper portion extending generally to, or beyond, the waterline 93. The footing portion 106 is preferably filled at least in part with local sedimentary materials. The net buoyancy force generated by the pier 104, of course, is approximately equal to the weight of the water displaced by the pier 104, less the weight of the pier 104 itself, and is directed vertically upwards.

As an example, if we assume that the open chamber 103 is a right circular cylinder having a diameter D equal to about 200 feet and an air column height H equal to about 60 feet then the relevant buoyancy air volume of almost two million cubic feet. Therefore, by Archimedes principle, and assuming a sea water density of about 64 lbm/ft^3, we can easily generate a gross buoyancy force of about 60,000 tons.

The foot portion 103 of the pier 104 that is embedded in the waterway bed 91 is preferably filled with displaced sediment, and therefore does not contribute substantially to the buoyancy force.

The weight of the superstructure of the bridge 100, therefore, may be substantially offset by the buoyancy force on the piers 104, such that the waterway bed 91 does not react all of these very large forces. In a preferred embodiment of the invention, the resulting buoyancy force is selected (by appropriate choice of dimensions of the pier 104) to be approximately equal to the portion of the bridge 100 weight that the pier 104 is designed to support. For example, the net buoyancy force may be designed to be at least eighty or ninety percent of the design supported bridge weight. It is contemplated that water may be pumped into, and/or out of, the chamber 103, to achieve the desired buoyancy force, and optionally that the buoyancy may be actively controlled by such pumping.

As discussed above, the pier 104, is anchored in place by being partially embedded in the waterway bed 91, and may be further anchored through an optional piling 107 extending down into firmer strata, such as bedrock.

The bridge 100 utilizes a novel pier 104 structure that provides significant advantages over conventional bridge pier structures. In the embodiment shown in FIGS. 1-3, the piers 104 are generally cylindrical, shown illustratively and not by way of limitation, as a right circular cylinder. In particular, the piers 104 are substantially larger in volume than conventional pier structures. The larger overall size of the pier 104 permits the pier 104 to accommodate the watertight chamber(s) 103.

It is contemplated that the piers 104 may be readily installed as follows: First the pier 104 structures may be prefabricated. The piers 104, with sufficient buoyancy to float, may then be towed into position at the desired emplacement. Pumps, valves, or other means for transferring water into the pier 104 may then be used until the pier 104 has a net negative buoyancy. The pier 104 is then guided to the desired position in the waterway bed 91. Hydraulic excavation methods, which are well known in the art, may be utilized to embed the piers 104 in the waterway bed 91, with local sediment occupying a portion of the interior volume of the piers 104. It is contemplated, for example, that a pump may be incorporated into the footing portion 106, that is adapted for hydraulically moving sediment located directly below the footing portion 106. Ports (not shown) may be provided near the upper end of the footing portion 106, to allow some of the sediment to be expelled from the footing portion 106. Once the piers are in place, and after and/or during construction of the bridge superstructure, and in particular those portions of the bridge superstructure that are supported by each pier 104, water is pumped out of the pier 104, for example by pumping air, other gas, or a lightweight material such as a polymeric foam, into the chamber(s) 103, such that the pier 104 produces a net upward buoyancy force that substantially offsets the weight of the bridge superstructure and the weight of the pier 104, but not enough buoyancy to offset the weight of the ballast of sediment that is in the footing portion 106 of the pier 104.

It is noted that many estuaries wherein the present invention may be most suitable have waterway beds 91 comprising relatively fine sediment and similar small-particle matter, such that the piers 104 may be readily installed using conventional hydraulic excavation. It is clearly contemplated that a preliminary bed preparation step may be utilized to clear larger objects away from the emplacement cite, if necessary. When a piling 107 is desired, the piling 107, for example a cylindrical metal shaft, may be first driven into the bedrock 94 using conventional piling installation methods, and the pier 104 provided with an aperture for receiving the piling is lowered to slidably engage the piling 107. The pier 104 may be fixedly attached to the piling 107 after installation, if desired.

It will be appreciated that the buoyancy-stabilized piers 104 desirably provide a constant righting force on the piers 104. As suggested above, bridge 100 structure, including the piers 104 may be designed such that there is virtually no dead load on the soil due to the weight of the bridge.

Figure 4:
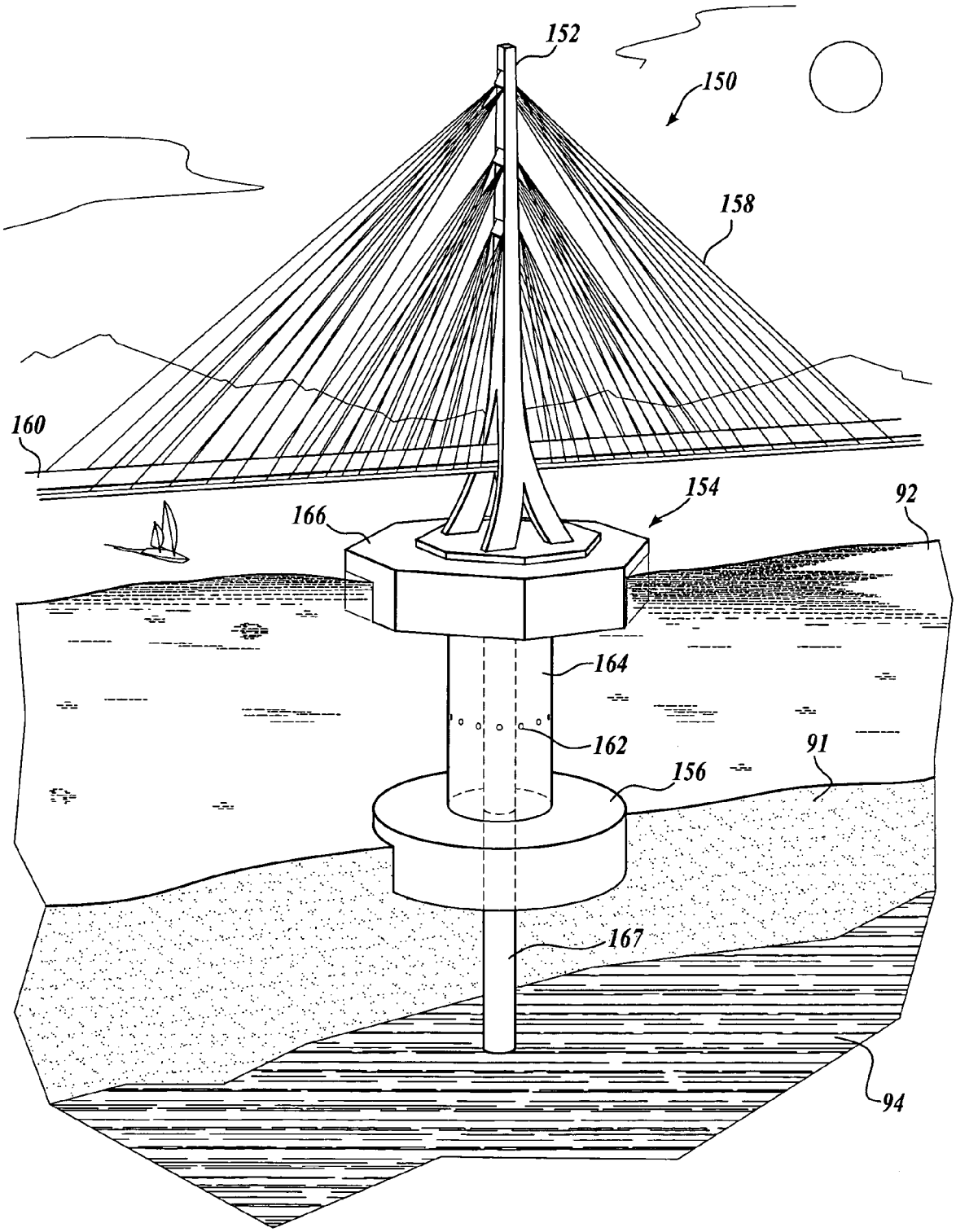
FIG. 4 is a second embodiment of a cable stayed bridge in accordance with the present invention.

A second embodiment of a cable stayed bridge 150 including a buoyant pier 154 according to the present invention is shown in FIG. 4. The bridge 150 includes a tower structure 152, cable stays 158 and deck 160 that are functionally similar to the bridge 100 described above. In this embodiment the pier 154 includes a relatively large-diameter footing portion 156, a relatively small-diameter middle section 164, and a relatively large-diameter upper portion 166. The footing portion 156, middle section 164 and upper portion 166 forming fixedly connected to form the pier 154.

The footing portion 156 is fully or substantially embedded in the waterway bed 91, and may include an optional piling 167 (not visible in FIG. 4) that extends further into the waterway bed 91, and generally anchors the pier 154 in place. The middle section 164 may be a solid section, or as shown in the cross-sectional view of FIG. 5, may be of tubular construction, preferably including apertures or ports 162, such that the middle section 164 will be substantially filled with water during use. The upper portion 166 comprises a hollow platform, that may conveniently be, for example, octagonal in plan form, as shown in FIG. 4, or may have any suitable alternative shape. It is believed advantageous to have one or more sides that are relatively straight, to facilitate docking watercraft thereto. The upper portion 166 may further include a peripheral bumper structure (not shown) such as the bumper structure 130 described above.

Figure 5:
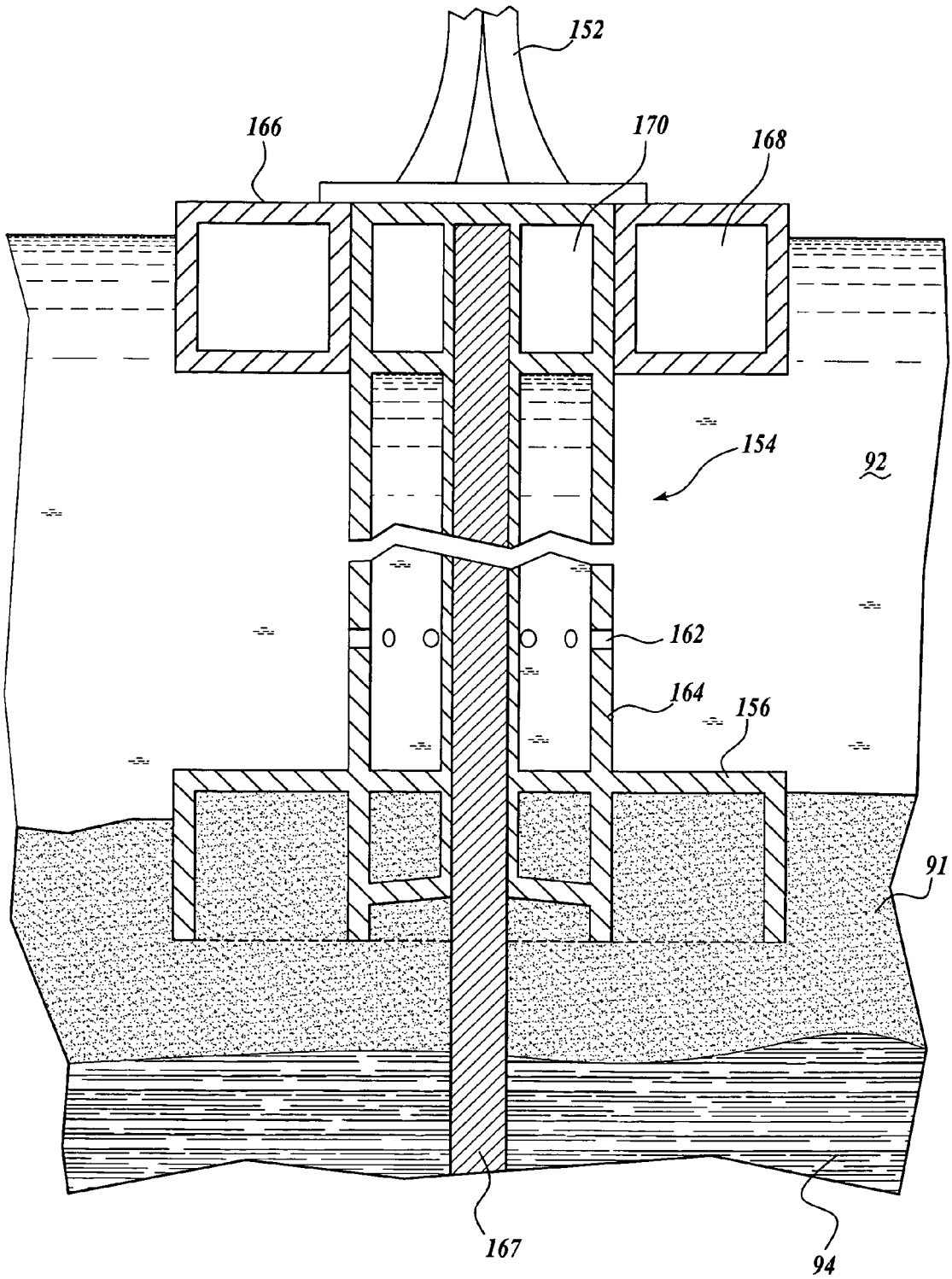
FIG. 5 is a cross sectional view of the pier for the cable stayed bridge shown in FIG. 4.

As seen most clearly in the pier 154 cross-sectional view shown in FIG. 5, the upper structure includes one or more chambers 168, 170. The chambers 168, 170 are substantially enclosed, although ports may be provided, for example to permit inspection or to permit metering in a desired amount of water to achieve a desired buoyancy. The upper portion 166 is sized to provide an upward buoyancy force that substantially reacts the weight loads applied to the pier 154 by the bridge 150 structure. Similar to the pier 104 of the first embodiment, the second embodiment of the pier 154 according to the present invention, therefore, allows the bridge 150 to be designed such that only a small portion of the dead weight of the bridge is transferred to the waterway bed 91. In this second embodiment, however, it should be appreciated, that the righting moment on the pier 154 is more positively active because the buoyancy forces are developed at the top of the pier 154.

The enlarged footing portion 156 shown in FIGS. 4 and 5 will help to distribute the loads (static and dynamic) that are transferred to the waterway bed 91, and may be most suitable when no piling 167 is to be used. Alternatively, the footing may be formed as generally the same diameter section as the middle section 164, similar to the first embodiment of the pier 104. The enlarged footing portion 156 embedded in the waterway will resist any overturning forces because to move or overturn the footing would require the movement of a large amount of soil under the footing and/or the creation of a vacuum under the footing, which is impossible, because there are no other forces available to do the job.

It is contemplated that the pier 154 primary structures may be formed of any suitable material, and in the current embodiments are preferably formed primarily from reinforced concrete. The chambers 168, 170 may be lined with a suitably watertight material, for example with a tar, polymeric liner or the like. Alternatively, the chambers (103 in pier 104, and 168, 170 in pier 154) may be filled with a stable polymeric foam or similar material suitable for the proposed environment, such that the buoyancy of the pier 104, 154 is assured even if cracks occur or the piers 104, 154 are otherwise damaged.

It will now be appreciated that by employing the teachings of the present invention, the weight of a relatively massive structure such as a cable stayed bridge, may be very substantially balanced by buoyancy forces resulting from the pier structure. Therefore, the vertical soil loading at the footing portion may be minimized or substantially eliminated. Moreover, the pier 104,154 will naturally tend towards the upright position, with the substantial portion of the weight of the pier in the footing portion and the net buoyancy force coming from the upper volume. Moreover, it is also believed that the embedded footing portion 106,156 will be substantially homogeneous with the surrounding soil because it is filled with the local sediment, so the tendency for external forces such as tidal currents and earthquakes to move the piers relative to the surrounding soils is minimal.

While illustrative embodiments have been illustrated and described, it will be appreciated that various changes can be made therein without departing from the spirit and scope of the invention.

The embodiments of the invention in which an exclusive property or privilege is claimed are defined as follows:

1. A cable stayed bridge comprising:

a plurality of piers, each pier supporting a tower structure;

a deck suspended by the tower structure with a plurality of cable stays;

wherein the piers each comprise a chamber filled with a buoyant material, and sized such that the buoyant pier structure produces a buoyancy force that is approximately equal to at least eighty percent of the weight of the supported tower structure including the weight of the deck supported by the tower structure; and wherein each of the plurality of piers include a footing portion that is embedded in a bed of a waterway during use.

2. The bridge of claim 1, wherein the buoyant material is air.

3. The bridge of claim 1, further comprising a piling that extends downwardly from the footing portion.

4. The bridge of claim 1, further comprising a waterproof material that lines the chamber.

5. The bridge of claim 1, further comprising a bumper assembly attached to at least one of the plurality of piers, the bumper assembly including an annular platform that surround the buoyant pier structure.

6. The bridge of claim 5, wherein the bumper assembly is attached to at least one of the plurality of piers with a plurality of extendable shock-absorbing members.

7. The bridge of claim 5, wherein the annular platform is generally polygonal in plan form.

8. The bridge of claim 1, wherein the plurality of piers each comprises a relatively large upper portion that defines the chamber, and a relatively slender middle portion that extends downwardly from the upper portion to the footing portion.

9. The bridge of claim 8, wherein the footing portion is relatively larger than the middle portion.

10. The bridge of claim 8, further comprising a piling that extends downward from the footing portion.

* * * * *